US007112919B2

(12) United States Patent
Huh et al.

(10) Patent No.: US 7,112,919 B2
(45) Date of Patent: Sep. 26, 2006

(54) TENSION MASK FRAME ASSEMBLY FOR COLOR CRT

(75) Inventors: Sung-Yul Huh, Kyungki-do (KR); Hyung-Seok Oh, Kyungki-do (KR); Sang-Hoon Lee, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/637,553

(22) Filed: Aug. 11, 2003

(65) Prior Publication Data

US 2004/0036404 A1 Feb. 26, 2004

(30) Foreign Application Priority Data

Aug. 20, 2002 (KR) ..... 10-2002-0049206

(51) Int. Cl.
*H01J 29/07* (2006.01)
*H01J 29/80* (2006.01)
*H01J 29/81* (2006.01)

(52) U.S. Cl. ..... 313/402; 313/404; 313/407

(58) Field of Classification Search ..... 313/402, 313/404–407

See application file for complete search history.

(56) References Cited

U.S. PATENT DOCUMENTS 5,111,107 A 5/1992 Kume et al.
5,898,259 A * 4/1999 Reyal ..... 313/407
6,054,803 A * 4/2000 Saita ..... 313/402
6,407,488 B1 * 6/2002 Ragland, Jr. ..... 313/402
6,469,431 B1 * 10/2002 Suzuki et al. ..... 313/407
6,479,925 B1 11/2002 Kim
6,590,326 B1 * 7/2003 Diven et al. ..... 313/402
2002/0036454 A1 * 3/2002 Lee ..... 313/402
2002/0135286 A1 * 9/2002 Ha et al. ..... 313/402

FOREIGN PATENT DOCUMENTS

JP 11-317176 11/1999
JP 2002216656 A * 8/2002

* cited by examiner

*Primary Examiner*—Nimeshkumar D. Patel
*Assistant Examiner*—Anthony Perry
(74) *Attorney, Agent, or Firm*—Stein, McEwen & Bui, LLP

(57) ABSTRACT

A tension mask frame assembly for a color CRT includes a pair of first and second support members separated a predetermined distance from each other, first and second elastic members installed at end portions of the first and second support members to support the first and second support members, a tension mask installed at the first and second support members such that a tensile force is applied to the first and second support member and having a plurality of electronic beam passing holes formed therein, and a compensation portion installed at the end portions of the first and second support members to make the tensile force applied to the tension mask after heat treatment distributed such that tension at a central portion is greater than that at a surrounding portion.

16 Claims, 6 Drawing Sheets

TENSION MASK FRAME ASSEMBLY FOR COLOR CRT

CROSS-REFERENCE TO RELATED APPLICATION

This application claims the benefit of Korean Patent Application No. 2002-49206 filed Aug. 20, 2002 in the Korean Intellectual Property Office, the disclosure of which is incorporated herein by reference.

BACKGROUND OF THE INVENTION

1. Field of the Invention

The present invention relates to a color cathode ray tube (CRT), and more particularly to a tension mask frame assembly for a color CRT having an improved frame for supporting a mask to which a tensile force is applied.

2. Description of the Related Art

In a typical color CRT, three electron beams emitted from an electron gun pass through electron beam passing holes of a shadow mask having a color selection function and land on phosphors of red, green, and blue of a fluorescent film formed on a screen surface of a panel so that the fluorescent substances are excited to form an image.

In a color CRT forming an image, the mask having a color selection function is classified as a dot mask used in a monitor of a computer or a slot mask (or a slit mask) used in a television. The mask is fixed to the frame and installed to the panel of the CRT.

The slot mask is further classified as a forming mask designed to have a curvature corresponding to that of the screen surface considering the screen surface and the landing of the deflected electron beams, or a tension mask supported so that a tensile force can be applied considering a flat screen surface of a panel to correct distortion of an image and enlarge a view angle of the screen.

A coupling structure of the mask and the frame in which a tensile force is applied to the mask is disclosed in Japanese Patent Publication Nos. sho 59-18825 (1984) and sho 59-16626 (1984).

A mask frame assembly to prevent the amount of expansion of the frame in a direction in which a tensile force is applied to the mask is disclosed in U.S. Pat. No. 5,111,107.

The disclosed mask frame assembly is shown in FIG. 1. As shown in the drawing, the mask frame assembly includes a pair of support bars 11 installed to face each other, a pair of elastic support members 12 installed between the support bars 11 to support the support bars 11, a mask 13 supported by the support bars 11, and metal members 14 attached to surfaces of the respective elastic support members 12 opposite to the side where the mask 13 is installed and having a thermal expansion coefficient greater than that of the elastic support members 12.

In the mask frame assembly 10, even though metal members 14 are attached, deterioration of tensile forces occurs in the mask 13 after heat treatment so that the effect of the metal members 14 varies according to the distribution of tension in the x- and y-directions.

A color CRT having a mask frame assembly to reduce the decrease of tension of a mask during a blackening process and a heat treatment is disclosed in Japanese Patent Publication No. hei 11-317176.

The color CRT includes a pair of support bodies facing each other and a color selection electrode where a grid is suspended on a frame made of a pair of elastic support members installed between the support bodies. A control member having a lower thermal expansion coefficient in a low temperature area and a higher thermal expansion coefficient in a high temperature area, compared to the thermal expansion coefficient of the elastic support body, is fixed to a surface opposite to the grid of the elastic support member, or a control member having features opposite to the above control member is fixed to the elastic support member at the side corresponding to the grid.

The color selection apparatus of a color CRT having the above structure cannot solve the above problem of properly supporting a mask because the control member is attached to the elastic support member having a different thermal expansion coefficient.

Another conventional tension mask frame assembly attempting to solve the above problem of properly supporting a mask discloses a pair of first and second support members separated by a predetermined distance, first and second elastic members installed between the first and second support members to support the first and second support members and having support portions fixed to the first and second support members and connection portions connecting the support portions. The mask is installed such that tension is applied to the first and second support members and has a plurality of electron beam passing holes. A compensation member is installed to connect the first and second support members or support portions between the connection portions and the mask and is made of a material having a thermal expansion coefficient lower than that of the first and second elastic members.

In the above tension mask frame assembly, by installing the compensation member so as to connect both end portions of the first and second elastic members or end portions of the first and second support members between the upper portion of the connection portions of the first and second elastic members and the lower portion of the mask, the thermal expansion of the first and second elastic members acts as a tensile force to the mask so that the mask is prevented from being plastically deformed.

However, in the tension mask frame assembly having the above structure, the tension of the tension mask changes due to differences in the thermal expansion amounts of the frame, the support portion, and the tension mask occurring after heat treatment. The tension of this conventional deformed tension mask cannot be adjusted after the heat treatment.

SUMMARY OF THE INVENTION

To solve the above and other problems, the one aspect of the present invention provides a tension mask frame assembly for a color CRT which can reduce a howling phenomenon of the tension mask, generated by an external impact, by adjusting a tensile force applied to the tension mask and by compensating for thermal expansion differences of different parts of the assembly during heat treatment.

Also, one aspect of the present invention provides a tension mask frame assembly for a color CRT in which the tension applied to the tension mask during heat treatment can be adjusted.

According to one aspect of the present invention, a tension mask frame assembly for a color CRT comprises first and second support members separated a predetermined distance from each other, first and second elastic members installed at end portions of the first and second support members to support the first and second support members, a tension mask installed at the first and second support members such that a tensile force is applied to the first and second support member and having a plurality of electronic beam passing holes formed therein, and a compensation portion installed at the end portions of the first and second support members so as to distribute the tensile force applied to the tension mask after heat treatment such that tension at a central portion of the mask is greater than that at a surrounding portion of the mask.

The compensation portion comprises compensation members welded to the end portions of the first and second support members. For a width of the compensation member W1 ,a welding length between the compensation members and the first and second support members W2 ,a tensile force at the central portion of the tension mask T1,and a tensile force at the surrounding portion T2 ,so as to make an A-type distribution (T2/T1<1.0), the dimensions of the respective members are adjusted so that 0.5<W2/W1≦1.0 is satisfied.

An area WA of the welding portion is expressed as WA=N×F/Y when a ratio of a load applied to the compensation member to an initial pressure load in a direction in which the first and second support members face each other during welding of the tension mask is N, the initial pressure load applied to the first and second support members is F, and a yield strength at the maximum temperature during heat treatment is Y.

Additional aspects and advantages of the invention will be set forth in part in the description which follows and, in part, will be obvious from the description, or may be learned by practice of the invention.

BRIEF DESCRIPTION OF THE DRAWINGS

These features and/or other aspects and advantages of the invention will become apparent and more readily appreciated from the following description of the embodiments taken in conjunction with accompanying drawings in which.

DETAILED DESCRIPTION OF THE INVENTION

Figure 1:
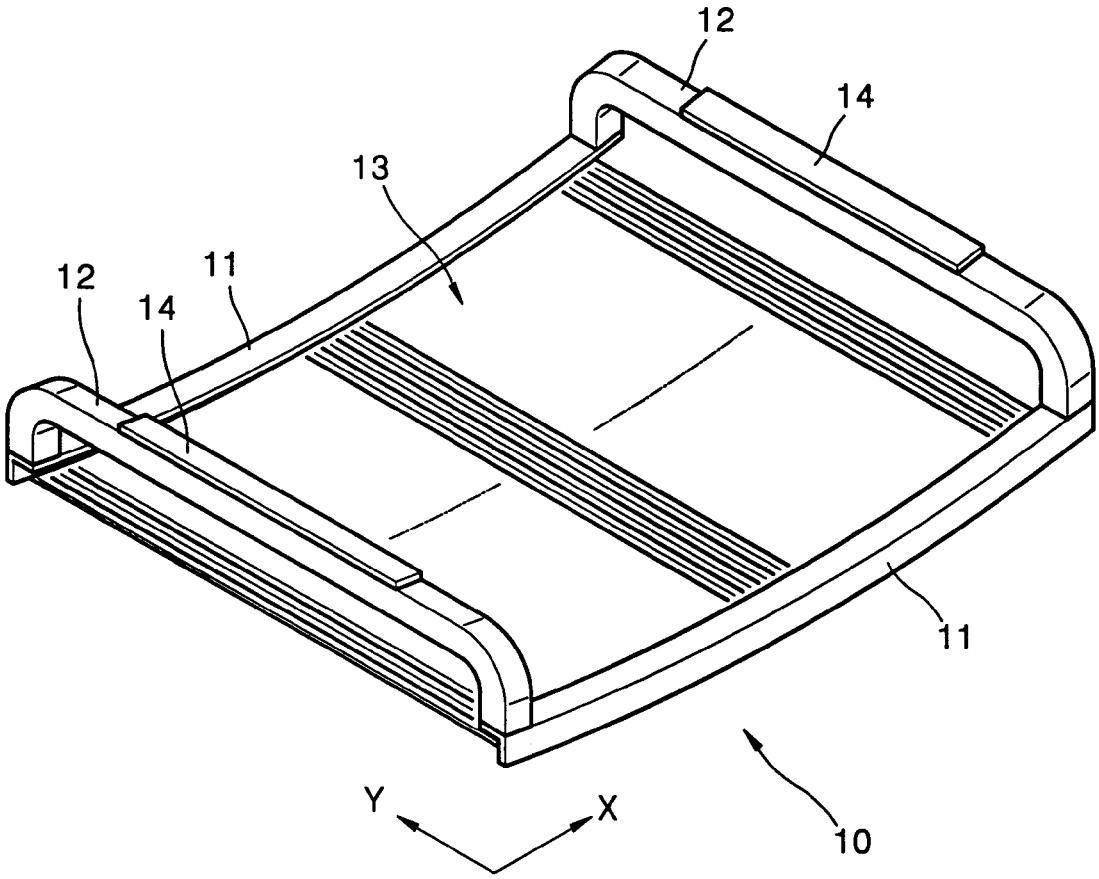
FIG. 1 (PRIOR ART)
FIG. 1 is a perspective view illustrating a conventional mask frame assembly.

Reference will now be made in detail to the embodiments of the present invention, examples of which are illustrated in the accompanying drawings wherein like reference numerals refer to the like elements throughout. The embodiments are described below in order to explain the present invention by referring to the figures.

Figure 2:
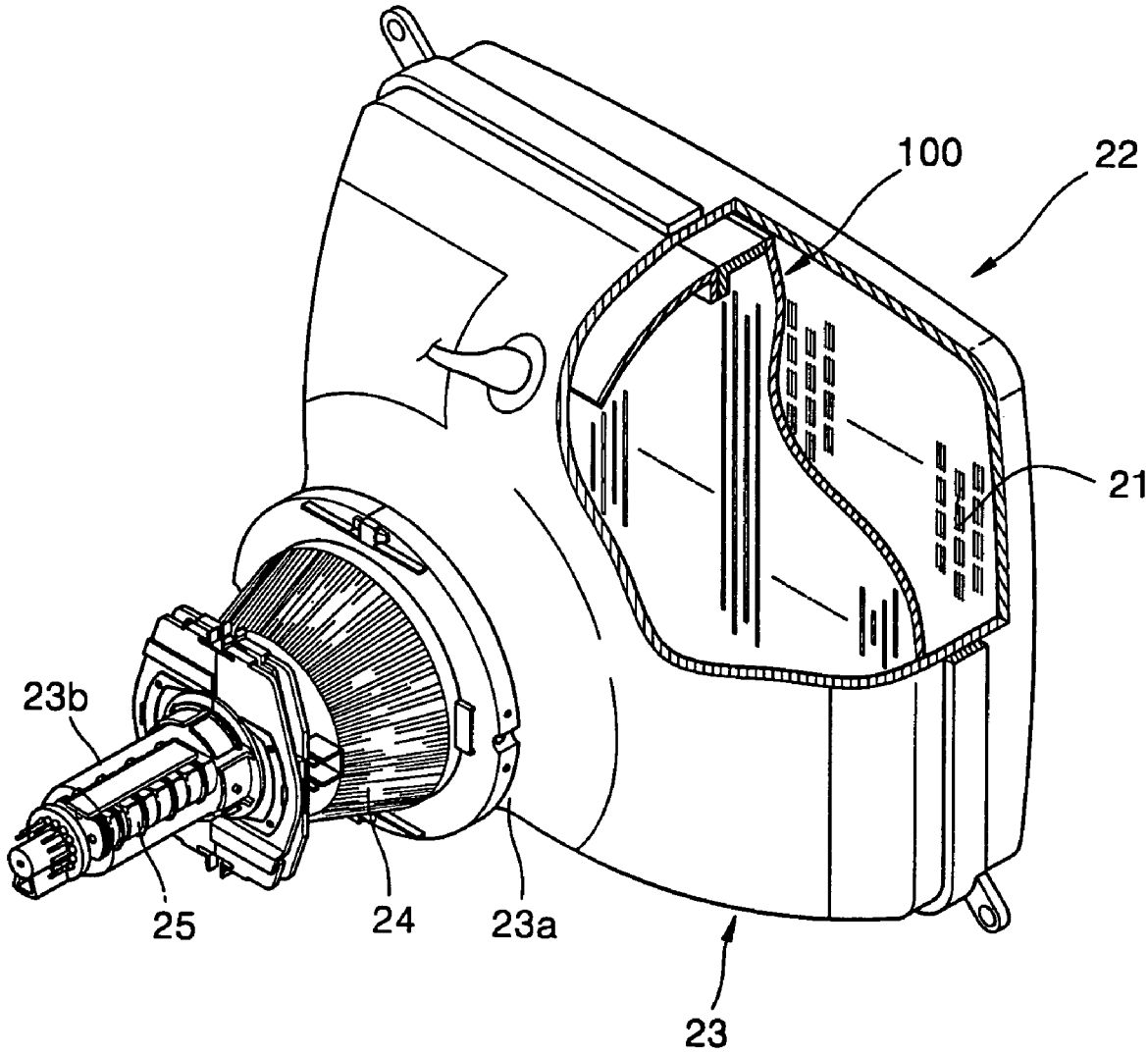
FIG. 2 is a partially cut-away perspective view illustrating a color CRT according to the one aspect of the present invention.

FIG. 2 shows a color CRT having a tension mask frame assembly according to one aspect of the present invention. As shown in FIG. 2, a color CRT includes a panel 22 having a flat screen 21 where a fluorescent film is formed, a funnel 23 sealed to the panel 22 and having a cone portion 23*a* and a neck portion 23*b*, a deflection yoke 24 installed throughout the cone portion 23*a* and the neck portion 23*b* of the funnel 23, and an electronic gun 25 installed in the neck portion 23*b* forming a seal. A tension mask frame assembly 100 having a function of color selection of electron beams emitted from the electron gun 25 is installed on an inner surface of the panel 22.

Figure 3:
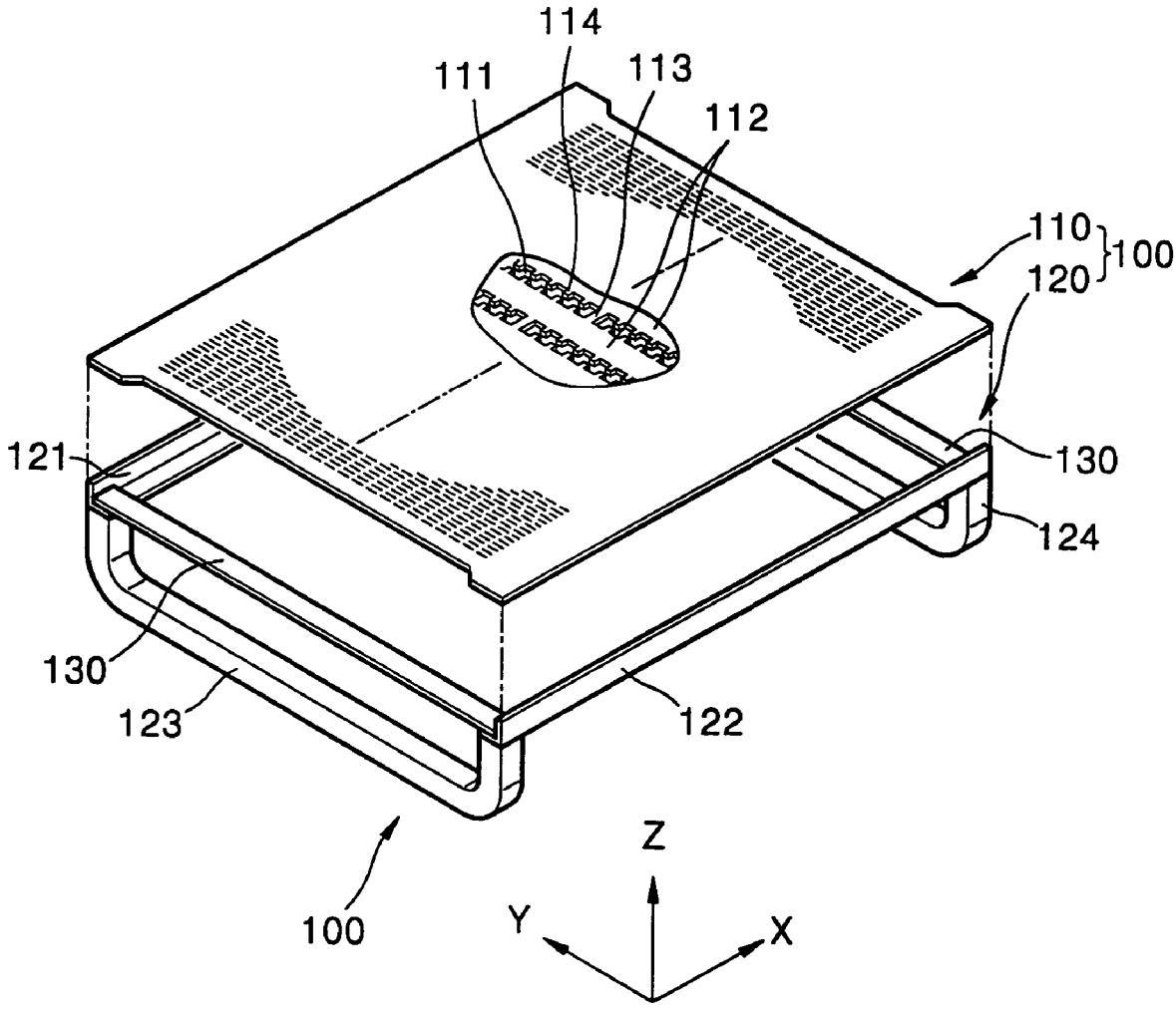
FIG. 3 is an exploded perspective view illustrating a tension mask frame assembly according to one aspect of the present invention.

The tension mask frame assembly 100, as shown in FIG. 3, includes a tension mask 110 and a frame 120 supporting the tension mask 110 so as to apply a tensile force to the tension mask 110.

The tension mask 110 includes a plurality of strips 112 separated by a predetermined distance and forming a slit 111, and a real bridge 113 connecting the strips 112 and sectioning the slit 111. According to an aspect of the present invention, the strips 112 adjacent to each other further include dummy bridges 114 extending in a direction facing each other and sectioning the slit 111. The tension mask 110 is not limited by the above-described embodiment, and various tension masks having a structure capable of applying a tensile force can be adopted therefor.

To support both opposite edges of the tension mask 110, the frame 120 includes first and second support members 121 and 122 separated by a predetermined distance, and first and second elastic members 123 and 124 supporting the first and second support members 121 and 122 such that tension is applied to the tension mask 110 supported by the first and second support members 121 and 122. The structures of the first and second support members 121 and 122 and the first and second elastic members 123 and 134 are not limited to the above-described embodiment so that various structures capable of applying a tensile force to the tension mask 110 can be adopted therefor. To prevent plastic deformation of the tension mask 110 and reduction of tension due to differences in thermal expansion between the first and second elastic members 123 and 124 and the tension mask 110 during blackening and annealing processes of the tension mask frame assembly 100, a compensation member 130 made of a flat bar, or an angle bar, and having a thermal expansion coefficient lower than that of the first and second support members 121 and 122 or the first and second elastic members 123 and 124 is fixedly welded so as to connect end portions of the first and second support members 121 and 122.

Figure 4:
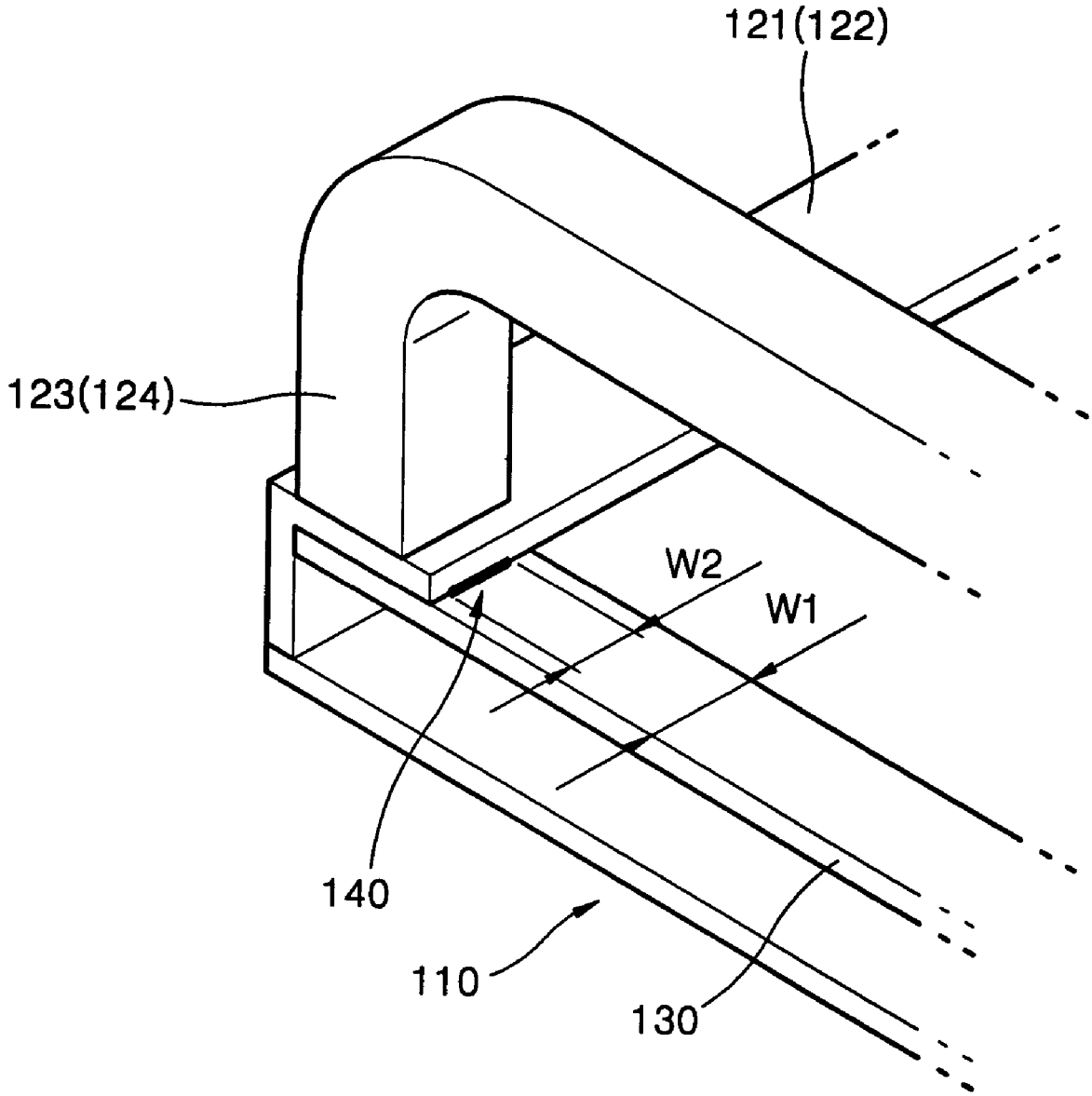
FIG. 4 is a partially cut-away perspective view illustrating a compensation member welded to a support member of the mask frame assembly of FIG. 3.
Figure 5A:
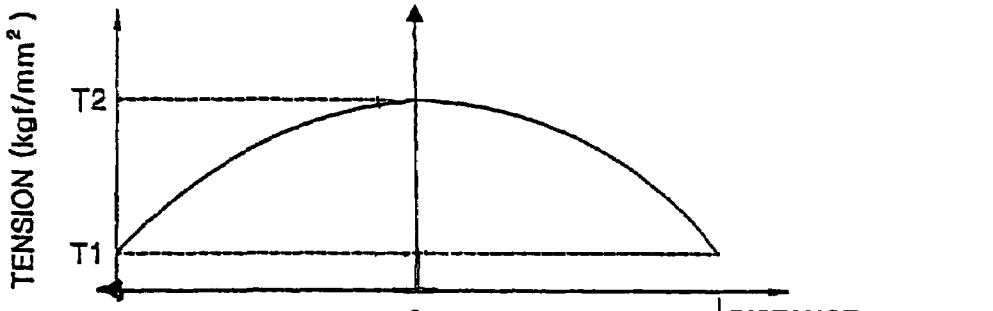
FIGS. 5A–5B illustrate tensile force applied to the tension mask by first and second support members.
Figure 5B:
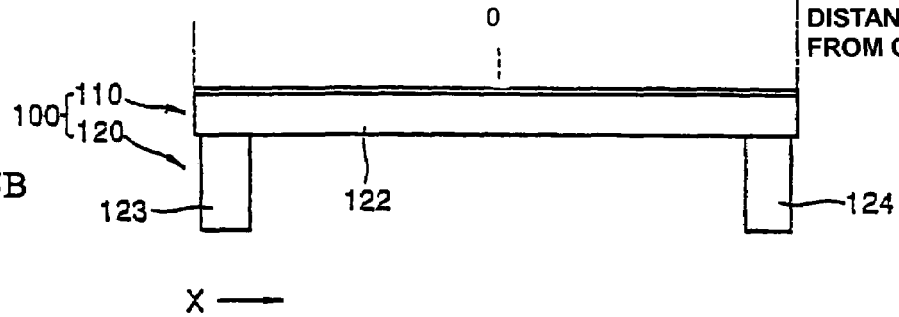

In the tension mask frame assembly 100 having the above structure, since the thermal expansion coefficient of the compensation member 130 is relatively low, during heat treatment, stress is concentrated on a welding portion between the first and second support members 121 and 122 and the compensation member 130, as shown in FIG. 4. Thus, the stress exceeds yield strength so that plastic deformation is generated. The plastic deformation affects the tension applied to the tension mask 110 after the heat treatment so that a distribution is formed in which tension increases at the surrounding portion of the tension mask 110. According to one aspect of the present invention, by limiting the area of the welding portion 140 between the compensation member 130 and the first and second support members 121 and 122, the distribution of tension of the tension mask 110 can be adjusted. That is, after the welding portion 140 passes through the heat treatment, the distribution of tension of the tension mask 110 in a direction along the long side is of an A-type distribution in which the tension of the central portion is relatively greater than that of the surrounding portion, as shown in FIGS. 5A–5B.

In detail, as shown in FIG. 4, assuming that the width of the compensation member 130 is W1 ,the welding length between the compensation member 130 and the first and second support members 121 and 122 is W2, and the tension at the central portion of the tension mask 110 is T1 and the tension at the surrounding portion of the tension mask 110 is T2 to make A-type distribution (T2/T1<1.0), 0.5<W2/W1≦1.0 is satisfied.

Figure 6:
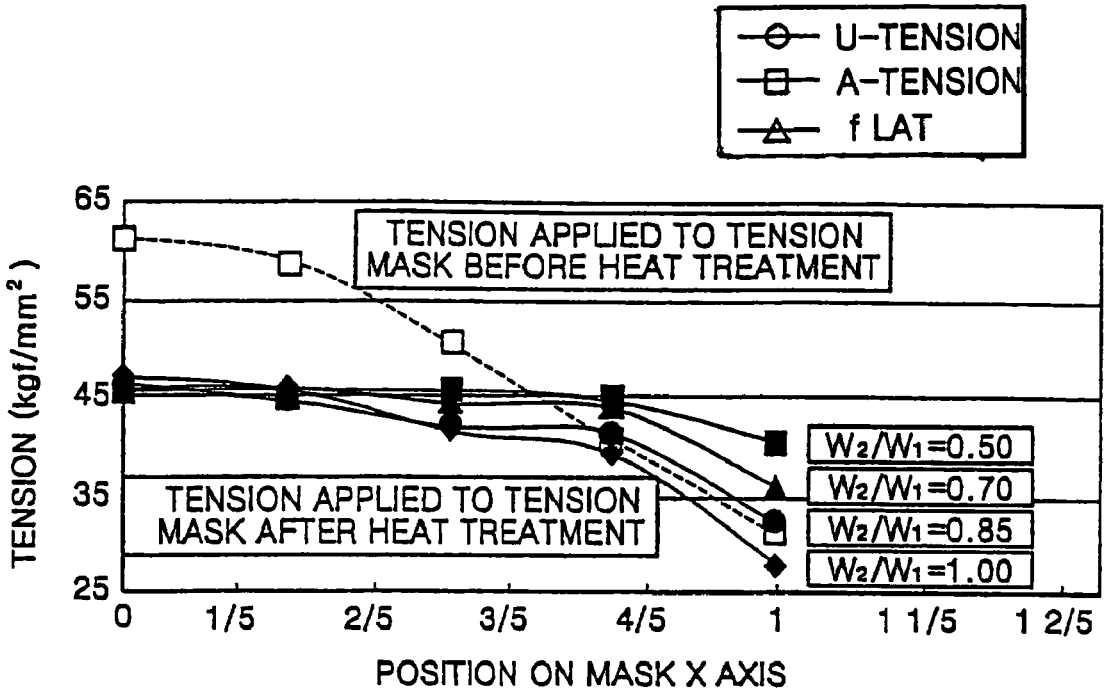
FIG. 6 is a graph showing a relationship between tension and W2/W1.

The graph of FIG. 6 shows a relationship between the tension applied to the tension mask and the width W1 and the welding length W2 of the compensation member 130. As shown in the graph, although the distribution of tension in a direction along a long side of the tension mask before heat treatment is of the A-type distribution in which the tension of the central portion is greater than that of the surrounding portion, it can be seen that due to heat treatment, tension differences between the central portion and the surrounding portion are gradually decreased. In particular, it can be seen that the distribution of tension at the central portion and the surrounding portion relatively increases as the value of W2/W1 increases from 0.5 to 1.0.

When a ratio of a load applied to the compensation member 130 to the initial pressure load in a direction in which the first and second support members 121 and 122 face each other during welding of the tension mask 110 is N, the area of the welding portion 140 is WA, the initial pressure load applied to the first and second support members 121 and 122, that is, a load applied to the first and second support members 121 and 122 in the direction facing each other to elastically deform the first and second elastic members 123 and 124 to weld the tension mask 110 to the first and second support members 121 and 122 is F, and a yield strength at the maximum temperature during the heat treatment of the compensation member 130 is Y, the area of the welding portion with respect to the first and second support members 121 and 122 is WA=N×F/Y. According to the result of a simulation of the above equation according to one aspect of the invention, N is approximately 70%.

The tension mask frame assembly for a color CRT having the above structure according to one aspect of the present invention passes through a heat treatment in a state in which the tension mask 110 is installed at the frame 120 such that a tensile force is applied to the frame 120, in which the tension mask frame assembly is heated to around 500° C. for blackening of the tension mask and the frame and removal of stress.

In the process of the heat treatment, when the tension mask frame assembly 100 is heated, the tension mask 110, the frame 120, and the compensation member 130 thermally expand. Since the thermal expansion coefficient of the compensation member 130 is lower than that of the first and second elastic members 123 and 124, stress is concentrated on the welding portion between the first and second support members 121 and 122 and the compensation member 130 so that a yield phenomenon is generated. However, since the welding length and the area of the first and second support members 121 and 122 and the compensation member 130 are restricted, a change in the tension of the tension mask 110 according to the yield can be reduced. Furthermore, the tensile force to be applied to the tension mask 110 can be adjusted.

Figure 7:
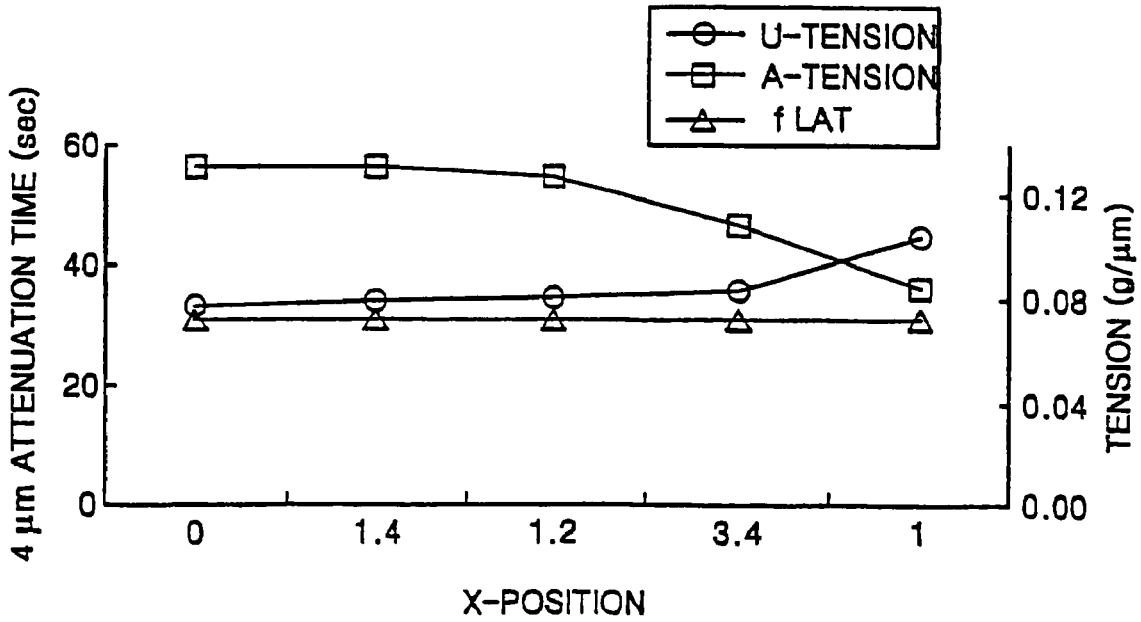
FIG. 7 is a graph showing time for vibration attenuation according to the type of distribution of tension.

As described above, in the tension mask frame assembly for a color CRT according to one aspect of the present invention, when the tension mask is of an A-tension type in which the tension is greater at the central portion than the surrounding portion as shown in FIG. 7, a howling phenomenon of the tension mask due to an external impact can be considerably reduced by adjusting the distribution of the tension applied to the tension mask.

Although a few embodiments of the present invention have been particularly shown and described, it would be appreciated by those skilled in the art that changes may be made therein in these embodiments without departing from the principles and spirit of the invention, the scope of which is defined in the claims and their equivalents.

What is claimed is:

1. A tension mask frame assembly for a cathode ray tube (CRT), comprising:

a frame comprising first and second support members separated a predetermined distance from each other; and first and second elastic members installed at end portions of the first and second support members to support the first and second support members;

a tension mask installed on the first and second support members so that a tensile force is applied to the first and second support members; and a compensation portion installed at the end portions of the first and second support members, extending from the first support member to the second support member, and disposed between the first and second elastic members and the tension mask, so the tensile force applied to the tension mask after heat treatment is distributed such that tension at a central portion of the tension mask is greater than that at a surrounding portion of the tension mask, wherein the compensation portion comprises a plurality of compensation members welded to end portions of the first and second support members, and wherein a width of each of the compensation members is W1, and a welding length between each of the compensation members and each of the first and second support members is W2, such that 0.5<W2/W1 1.0.

2. The tension mask frame assembly according to claim 1, wherein an area of a welding portion is substantially N*F/Y, where N is a ratio of a load applied to the compensation members to an initial pressure load in a direction in which the first and second support members face each other during welding of the tension mask, F is an initial pressure load applied to the first and second support members, and Y is a yield strength at a maximum temperature during heat treatment of the compensation members.

3. The tension mask frame assembly according to claim 1, wherein the tension mask comprises a plurality of electronic beam passing holes formed therein.

4. The tension mask frame assembly according to 2, wherein N is substantially 70%.

5. A tension mask frame assembly for a CRT, comprising:

a plurality of support members;

a tension mask installed on the plurality of support members so that a tensile force is applied to the support members; and a plurality of compensation members attached at end portions of the plurality of support members, each of the compensation members having distal ends extending from one of the support members to another of the support members;

wherein an area in which the distal ends of each compensation member are attached at end portions of the respective support members is substantially N*F/Y, where N is a ratio of a load applied to the compensation members to an initial pressure load in a direction in that the support members face each other during installation of the tension mask, F is an initial pressure load applied to the support members, and Y is a yield strength at a maximum temperature during heat treatment of the compensation members.

6. The tension mask frame assembly according to claim 5, wherein a length of an attachment portion between each of the compensation members and each of the support members is no greater than a width of each compensation member.

7. The tension mask frame assembly according to claim 5, wherein a length of an attachment portion between each of the compensation members and each of the support members is greater than one-half of the width of the compensation member.

8. The tension mask frame assembly according to claim 6, wherein the attachment portion is a welding portion.

9. The tension mask frame assembly according to claim 5, wherein N is substantially 70%.

10. A color CRT, comprising:

a panel having a flat screen;

a funnel sealed to the panel having a cone portion and a neck portion;

a deflection yoke installed throughout the cone portion and neck portion of the funnel and an electronic gun installed in the neck so as to form a seal; and a tension mask frame assembly, comprising:

a frame comprising first and second support members separated a predetermined distance from each other, and first and second elastic members installed at end portions of the first and second support members to support the first and second support members, a tension mask installed on the first and second support members so that a tensile force is applied to the first and second support members, and having a plurality of electronic beam passing holes formed therein, and a compensation portion installed at the end portions of the first and second support members, extending from the first support member to the second support member, and disposed between the first and second elastic members and the tension mask, so the tensile force applied to the tension mask after heat treatment is distributed such that tension at a central portion of the tension mask is greater than that at a surrounding portion of the tension mask, wherein the compensation portion comprises a plurality of compensation members welded to end portions of the first and second support members, and wherein a width of each of the compensation members is W1, a welding length between each of the compensation members and each of the first and second support members is W2 such that $0.5<W2/W1\leqq 1.0$.

11. The color CRT according to claim 10, wherein an area of a welding portion is substantially N*F/Y, where N is a ratio of a load applied to the compensation portion to an initial pressure load in a direction in which the first and second support members face each other during welding of the tension mask, F is an initial pressure load applied to the first and second support members, and Y is a yield strength at a maximum temperature during heat treatment of the compensation portion.

12. A tension mask frame assembly, comprising:

a frame comprising a plurality of support members separated a predetermined distance from each other; and a plurality of elastic members installed at end portions of the support members;

a tension mask installed on the support members so that a tensile force is applied to the support members; and a compensation portion installed at the end portions of the support members, extending from one of the support members to another of the support members, and disposed between the elastic members and the tension mask, so the tensile force applied to the tension mask is distributed such that tension at a central portion of the tension mask is greater than that at a surrounding portion of the tension mask, wherein the compensation portion comprises a plurality of compensation members welded to end portions of the support members, and wherein a width of each of the compensation members is W1 , a welding length between each of the compensation members and each of the first and second support members is W2 such that $0.5<W2/W1\leqq 1.0$.

13. The tension mask frame assembly according to claim 12, wherein an area of a welding portion is substantially N*F/Y, where N is a ratio of a load applied to the compensation members to an initial pressure load in a direction in the support members face each other during welding of the tension mask, F is an initial pressure load applied to the support members, and Y is a yield strength at a maximum temperature during heat treatment of the compensation members.

14. A tension mask frame assembly, comprising:

a frame comprising first and second support members separated a predetermined distance from each other; and first and second elastic members installed at end portions of the first and second support members to support the first and second support members;

a tension mask installed on the first and second support members so that a tensile force is applied to the first and second support members; and first and second compensation members welded to end portions of the first and second support members, extending from the first support member to the second support member along a direction of the first and second elastic members, and disposed between the first and second elastic members and the tension mask, so the tensile force applied to the tension mask after heat treatment is distributed such that tension at a central portion of the tension mask is greater than that of a surrounding portion of the tension mask;

wherein a width of each of the compensation members is W1, and a welding length between each of the first and second compensation members and each of the first and second support members is W2, such that $0.5<W2/W1\leqq 1.0$.

15. The tension mask frame assembly according to claim 14, wherein an area of a welding portion is substantially N*F/Y, where N is a ratio of a load applied to the first and second compensation members to an initial pressure load in a direction in which the first and second support members face each other during welding of the tension mask, F is an initial pressure load applied to the first and second support members, and Y is a yield strength at a maximum temperature during heat treatment of the first and second compensation members.

16. The tension mask frame assembly according to 15, wherein N is substantially 70%.

* * * * *

UNITED STATES PATENT AND TRADEMARK OFFICE

CERTIFICATE OF CORRECTION

PATENT NO. : 7,112,919 B2
APPLICATION NO. : 10/637553
DATED : September 26, 2006
INVENTOR(S) : Sung-Yul Huh et al.

It is certified that error appears in the above-identified patent and that said Letters Patent is hereby corrected as shown below:

Column 6, line 33, change "0.5<W2/W1 1.0" to --0.5<W2/W1≤1.0--

Column 7, line 47, insert -- , -- after "W2"

Column 8, line 15, insert -- , -- after "W2"

Signed and Sealed this

Sixth Day of February, 2007

JON W. DUDAS
*Director of the United States Patent and Trademark Office*